US011684825B2

(12) United States Patent
Wan

(10) Patent No.: US 11,684,825 B2
(45) **Date of Patent: *Jun. 27, 2023**

(54) GOLF BALL SCRIBER

(71) Applicant: Kevin Wan, La Jolla, CA (US)

(72) Inventor: Kevin Wan, La Jolla, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/443,449

(22) Filed: Jul. 26, 2021

(65) Prior Publication Data

US 2023/0025303 A1 Jan. 26, 2023

(51) Int. Cl.
*A63B 45/02* (2006.01)
*A63B 37/00* (2006.01)

(52) U.S. Cl.
CPC ..... *A63B 45/02* (2013.01); *A63B 37/0022* (2013.01)

(58) Field of Classification Search
CPC ..... A63B 45/02
See application file for complete search history.

(56) References Cited

U.S. PATENT DOCUMENTS 557,014 A * 3/1896 Osgood ..... B43L 25/007 15/257.05
2,561,947 A * 7/1951 Ellis ..... A63B 45/02 101/4
8,191,276 B1 * 6/2012 Yi ..... A63B 45/02 33/565
10,881,930 B1 * 1/2021 Allen ..... A63B 57/20
11,298,594 B1 * 4/2022 Wan ..... B41F 17/30
2001/0053721 A1 * 12/2001 Tyke ..... B05C 13/02 473/257
2002/0005124 A1 * 1/2002 Parks ..... A63B 69/3688 101/127
2002/0086741 A1 * 7/2002 Newcomb ..... A63B 43/008 473/351

(Continued)

FOREIGN PATENT DOCUMENTS

CN 112619083 A * 4/2021 ..... A63B 57/00
KR 10-2015-0068736 6/2015
KR 20-0486405 5/2018

OTHER PUBLICATIONS

Kaiwen, CN 112619083A machine translation, upoloaded Aug. 29, 2022, Espacent, 6 pages.*

*Primary Examiner* — Eugene L Kim
*Assistant Examiner* — Matthew B Stanczak
(74) *Attorney, Agent, or Firm* — F. Chau & Associates, LLC

(57) ABSTRACT

A golf ball scriber includes: a clip comprising a first clip body and a second clip body which are connected by a pivot shaft; a clamping groove surface disposed on an inner clamping surface of the clip; a sealed brush device; a first clip groove and a second clip groove symmetrically arranged on a respective outer wall of the first clip body and the second clip body; a scribing ruler disposed at a bottom surface of the first clip groove; a strip-shaped chamfered groove disposed on the scribing ruler away from the clamping groove surface; and a strip-shaped scribing groove disposed on the chamfered groove which corresponds to the clamping groove surface, wherein the scribing ruler, the chamfered groove, and the scribing groove share a central line, and the brush device is in sliding connection with the first clip groove disposed on the first clip body.

16 Claims, 14 Drawing Sheets

(56) References Cited

U.S. PATENT DOCUMENTS

| | | | | |
|---|---|---|---|---|
| 2003/0109319 | A1* | 6/2003 | Andresen | A63B 45/02 473/200 |
| 2003/0153396 | A1* | 8/2003 | Andresen | A63B 45/02 473/268 |
| 2007/0197309 | A1* | 8/2007 | Geraty | A63B 69/3688 473/257 |
| 2008/0271334 | A1* | 11/2008 | Sung | A63B 57/20 33/562 |
| 2013/0092036 | A1* | 4/2013 | Barrett | A63B 45/02 101/35 |
| 2013/0102416 | A1* | 4/2013 | Helms | B43L 13/205 473/378 |
| 2014/0119807 | A1* | 5/2014 | Tarlow | A63B 57/30 401/9 |
| 2015/0075395 | A1* | 3/2015 | Liao | A63B 45/02 101/35 |
| 2021/0308542 | A1* | 10/2021 | Parra | A63B 57/207 |

* cited by examiner

GOLF BALL SCRIBER

TECHNICAL FIELD

The patent disclosure relates to a golf ball equipment, and more particularly, to a golf ball scriber.

DISCUSSION OF THE RELATED ART

Golf is a popular sport and golf players depend on scribed lines on a spherical surface of a golf ball to make precise and high-quality shots. A golf ball scribing device or a line marker may be used to scribe or mark lines on the spherical surface of the golf ball. Additionally, ink used to scribe lines should be dried fast and water cannot easily scrub such ink. In some cases, players hope to make sure the angle that the ball is struck by the club head instantly faces the preset direction when striking the golf ball. For example, a little deviation may lead to the deviation of the direction of the ball, and consequently the golf ball may deviate from the expected landing point.

Existing golf ball scribing devices do not include an ink pen or a brush device for scribing. For example, a user carries both a golf ball scribing device and a separate ink pen, which is used to mark lines on the golf ball. This is not convenient for the user and the ink pen may be easily misplaced. Additionally, ink pen may be easily dried up without proper sealing mechanisms and the service lifetime of the ink pen is thus decreased.

SUMMARY

One or more embodiments of the present disclosure provide a golf ball scriber that integrates a brush device, which also has an increased sealing performance. In some cases, the golf ball scriber or golf scribing tool enables players to align lines or dots on a golf ball so that players have increased stability when striking a ball and increased accuracy in aiming. In an embodiment, a spring may be sleeved in the scribing guide sleeve and a spring retainer may be sleeved on an outer periphery of a lower part of the ink tank, where the spring and the spring retainer enable a pen core of the brush device to scribe lines on the surface of a golf ball. As a result, a pen nib of the brush device is maintained wet due to the increased sealing performance and the brush device has a relatively long service duration. Additionally, the golf ball scriber includes a less complex structure and is less expensive to manufacture.

According to an embodiment of the inventive concept, a golf ball scriber may include: a clip comprising a first clip body and a second clip body which are connected by a pivot shaft; a clamping groove surface disposed on an inner clamping surface of the clip; a sealed brush device; a first clip groove and a second clip groove symmetrically arranged on a respective outer wall of the first clip body and the second clip body; a scribing ruler disposed at a bottom surface of the first clip groove; a strip-shaped chamfered groove disposed on the scribing ruler away from the clamping groove surface along a radial direction of the clip; and a strip-shaped scribing groove disposed on the chamfered groove which corresponds to the clamping groove surface, wherein the scribing ruler, the chamfered groove, and the scribing groove may share a central line, and wherein the brush device may be in sliding connection with the first clip groove disposed on the first clip body.

In an embodiment of the inventive concept, the brush device of the golf ball scriber may include a U-shaped scribing track, an ink tank, a pen core, a scribing guide sleeve, a spring, wherein the spring may be sleeved in the scribing guide sleeve and may be coaxial with the scribing guide sleeve, a sealing cover, wherein the ink tank, the scribing guide sleeve, and the sealing cover may be sequentially connected from top to bottom, and wherein the U-shaped scribing track may be connected to the first clip groove, and a spring retainer, wherein the spring retainer may be sleeved on an outer periphery of a lower part of the ink tank, wherein a top end of the pen core may be disposed in the ink tank, wherein a low end of the pen core may pass through the scribing guide sleeve and enter the sealing cover, wherein a top end of the spring may be flush with an upper end surface of the scribing guide sleeve, and wherein a bottom end may abut against the upper end surface of the spring retainer.

In an embodiment of the inventive concept, the spring retainer may be disposed in the scribing guide sleeve and may be coaxial with the scribing guide sleeve, and a lower end surface of the spring retainer may be flush with a lower end surface of the scribing guide sleeve.

In an embodiment of the inventive concept, the sealing cover may be disposed in the first clip groove, and the scribing guide sleeve may be clamped on the U-shaped scribing track, and as the scribing guide sleeve slides on the U-shaped scribing track to the scribing groove, a pen nib of the pen core may pass through the scribing groove to scribe on a spherical surface of a golf ball.

In an embodiment of the inventive concept, a clamping hole clamped with the sealing cover may be disposed at the bottom of the first clip groove, and the clamping hole may be located at one end of the chamfered groove, the clamping hole and the chamfered groove may share a same central line, a No. 1 mortise may be disposed on each of two symmetrical side walls in the first clip groove along an axial direction of the clip, and the No. 1 mortise may be adapted to a No. 1 tenon disposed on the sealing cover.

In an embodiment of the inventive concept, at least two No. 2 mortises arranged at equal intervals may be disposed on each of two symmetrical side walls in the first clip groove along the axial direction of the clip. The at least two No. 2 mortises may be arranged along the radial direction of the clip. A No. 2 tenon may be disposed on each of two outer walls of the U-shaped scribing track along the radial direction of the clip, and the No. 2 tenon may be adapted to each of the at least two No. 2 mortises. A clamping block may be arranged in the middle of a side wall adjacent to the clamping hole in the first clip groove, and the clamping block may be clamped in a bayonet of the U-shaped scribing track.

In an embodiment of the inventive concept, the ink tank of the golf ball scriber may include an ink absorbent cotton, a box cover, an ink box, and a No. 1 hollow cylinder, wherein the box cover, the ink box, and the No. 1 hollow cylinder may be connected from top to bottom, wherein the box cover and the ink box may be rotatably connected and form a space for accommodating the ink absorbent cotton, wherein the No. 1 hollow cylinder may be vertically connected with a bottom of the ink box and is coaxial with the ink box, and wherein a lower part of the No. 1 hollow cylinder may include an abutting section with an outer diameter smaller than that of an upper part, and an abutting part may be disposed on the abutting section along a circumferential direction.

In an embodiment of the inventive concept, the ink tank moves towards the sealing cover, abutting against an upper end groove of the sealing cover through the abutting part, and a gap may exist between an upper end surface of the abutting section and the abutting part, and a gap may exist between a lower end surface of the abutting section and the abutting part.

In an embodiment of the inventive concept, the spring retainer may be sleeved on the abutting section and the spring retainer may be disposed on an upper part of the abutting part.

In an embodiment of the inventive concept, the brush device may include a U-shaped scribing track and a clamping table, and the clamping table is disposed on one end of the U-shaped scribing track.

In an embodiment of the inventive concept, a height of the clamping table may be higher than a height of a portion of the U-shaped scribing track.

In an embodiment of the inventive concept, the scribing guide sleeve of the golf ball scriber may include an I-shaped scribing body, and a No. 2 hollow cylinder, wherein the No. 2 hollow cylinder may be integrally connected to a lower part of the I-shaped scribing body and coaxial with the 1-shaped scribing body, and wherein the spring retainer may be disposed at a lower part of the No. 2 hollow cylinder and may be on a same level as a bottom end surface of No. 2 hollow cylinder.

According to an embodiment of the inventive concept, a golf ball scriber may include: a clip comprising a first clip body and a second clip body which may be connected by a pivot shaft; a clamping groove surface disposed on an inner clamping surface of the clip; a sealed brush device; and a first clip groove and a second clip groove symmetrically arranged on a respective outer wall of the first clip body and the second clip body, wherein the brush device may be in sliding connection with the first clip groove disposed on the first clip body.

In an embodiment of the inventive concept, the golf ball scriber may include a scribing ruler disposed at a bottom surface of the first clip groove; a strip shaped chamfered groove disposed on the scribing ruler away from the clamping groove surface along a radial direction of the clip; and a strip-shaped scribing groove disposed on the chamfered groove which corresponds to the clamping groove surface.

In an embodiment of the inventive concept, the scribing ruler, the chamfered groove, and the scribing groove may share a central line.

According to an embodiment of the inventive concept, a brush device may include: a U-shaped scribing track, an ink tank, a pen core, a scribing guide sleeve, a spring, wherein the spring may be sleeved in the scribing guide sleeve and may be coaxial with the scribing guide sleeve, a sealing cover, wherein the ink tank, the scribing guide sleeve, and the sealing cover may be sequentially connected from top to bottom, and wherein the U-shaped scribing track may be connected to a clip groove, and a spring retainer, wherein the spring retainer may be sleeved on an outer periphery of a lower part of the ink tank, wherein a top end of the pen core may be disposed in the ink tank, wherein a low end of the pen core may pass through the scribing guide sleeve and enter the sealing cover, wherein a top end of the spring may be flush with an upper end surface of the scribing guide sleeve, and wherein a bottom end may abut against the upper end surface of the spring retainer.

BRIEF DESCRIPTION OF THE DRAWINGS

Example embodiments will be described in greater detail hereinafter with reference to the accompanying drawings. In the accompanying drawings, dimensions may be exaggerated for clarity of illustration. It will be understood that when an element is referred to as being "between" two elements, it may be the only element between the two elements, or one or more intervening elements may also be present between the two elements.

The above and other features of the inventive concept will become more apparent by describing in detail example embodiments thereof with reference to the accompanying drawings, in which.

DETAILED DESCRIPTION OF THE EMBODIMENTS

Figure 1:
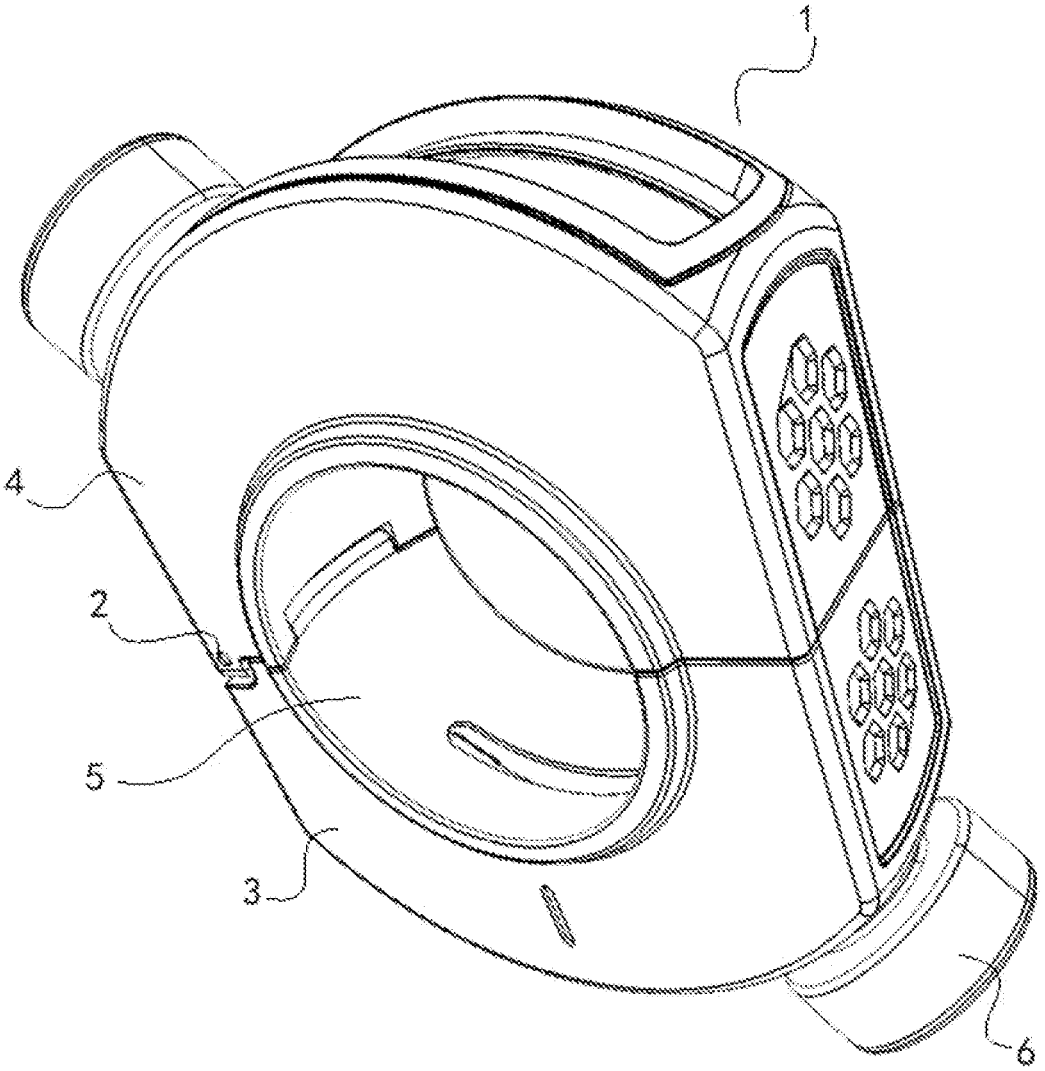
FIG. 1 is schematic diagram illustrating a three-dimensional (3D) structure of a golf ball scriber in accordance with embodiments of the present disclosure.

Like reference numerals may refer to like elements throughout this specification. In the figures, the thickness of lines, layers, components, or films or regions may be exaggerated for clarity. The term "and/or" includes any and all combinations of one or more of the associated listed items.

It will be understood that although the terms such as "first" and "second" are used herein to describe various elements, these elements should not be limited by these terms. The terms are only used to distinguish one component from other components. For example, a first element referred to as a first element in one embodiment may be referred to as a second element in another embodiment without departing from the scope of the appended claims. The singular forms, "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence and/or addition of one or more other features, integers, steps, operations, elements, components, and/or groups thereof.

Also, "under", "below", "above", "upper", and the like are used for explaining relational association of components or elements illustrated in the drawings. The terms are intended to be a relative concept and are described based on directions as illustrated in the drawings.

Here, it will be understood that when an element or layer is referred to as being "on", "connected", or "coupled to" another element or layer, it can be directly on, connected or coupled to the another element or layer, or one or more intervening elements may be present.

Hereinafter, example embodiments of the present disclosure will be described in detail with reference to the accompanying drawings.

Figure 2:
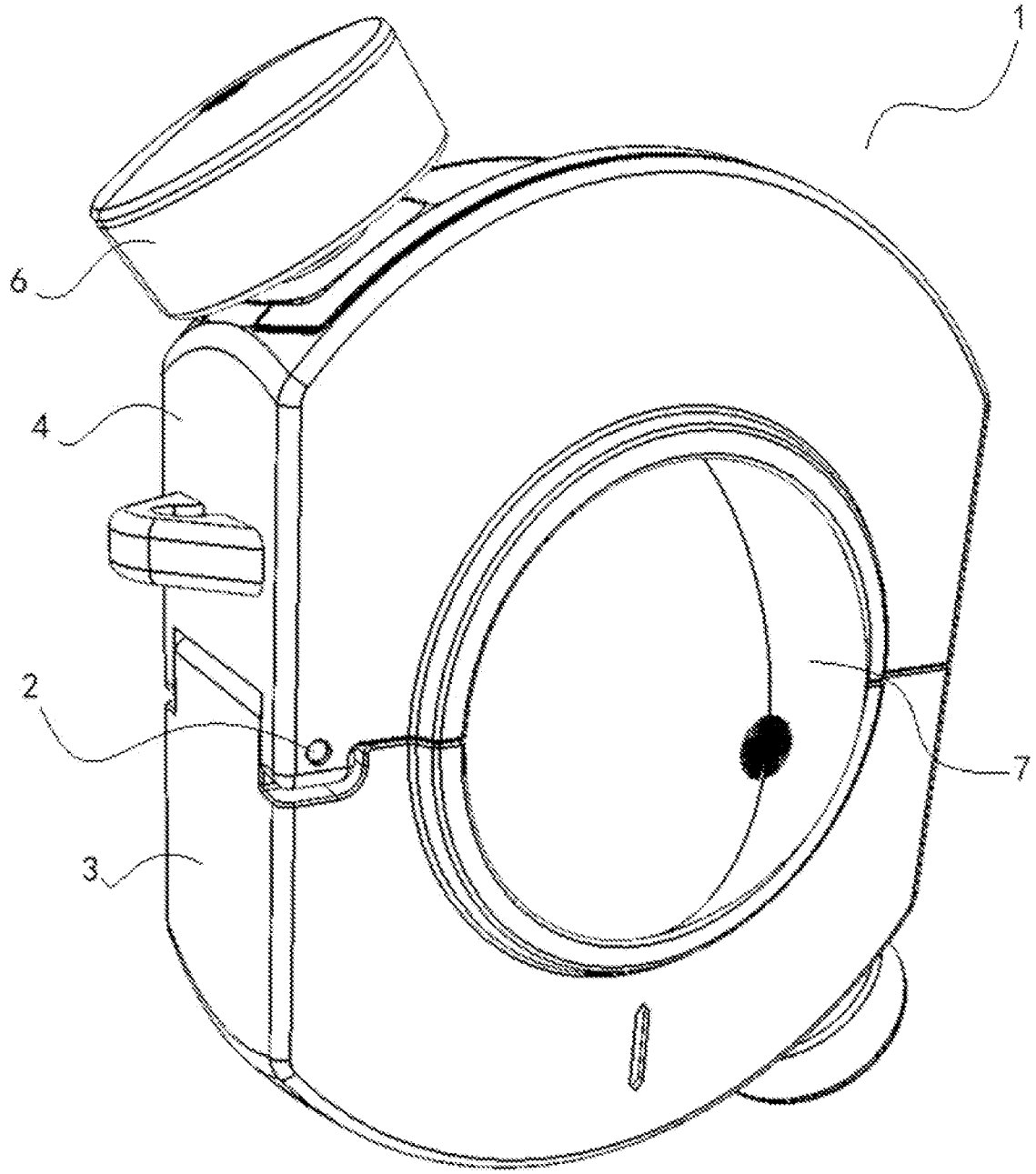
FIG. 2 is a schematic diagram illustrating a 3D structure in which a golf ball is installed inside a golf ball scriber in accordance with embodiments of the present disclosure.
Figure 3:
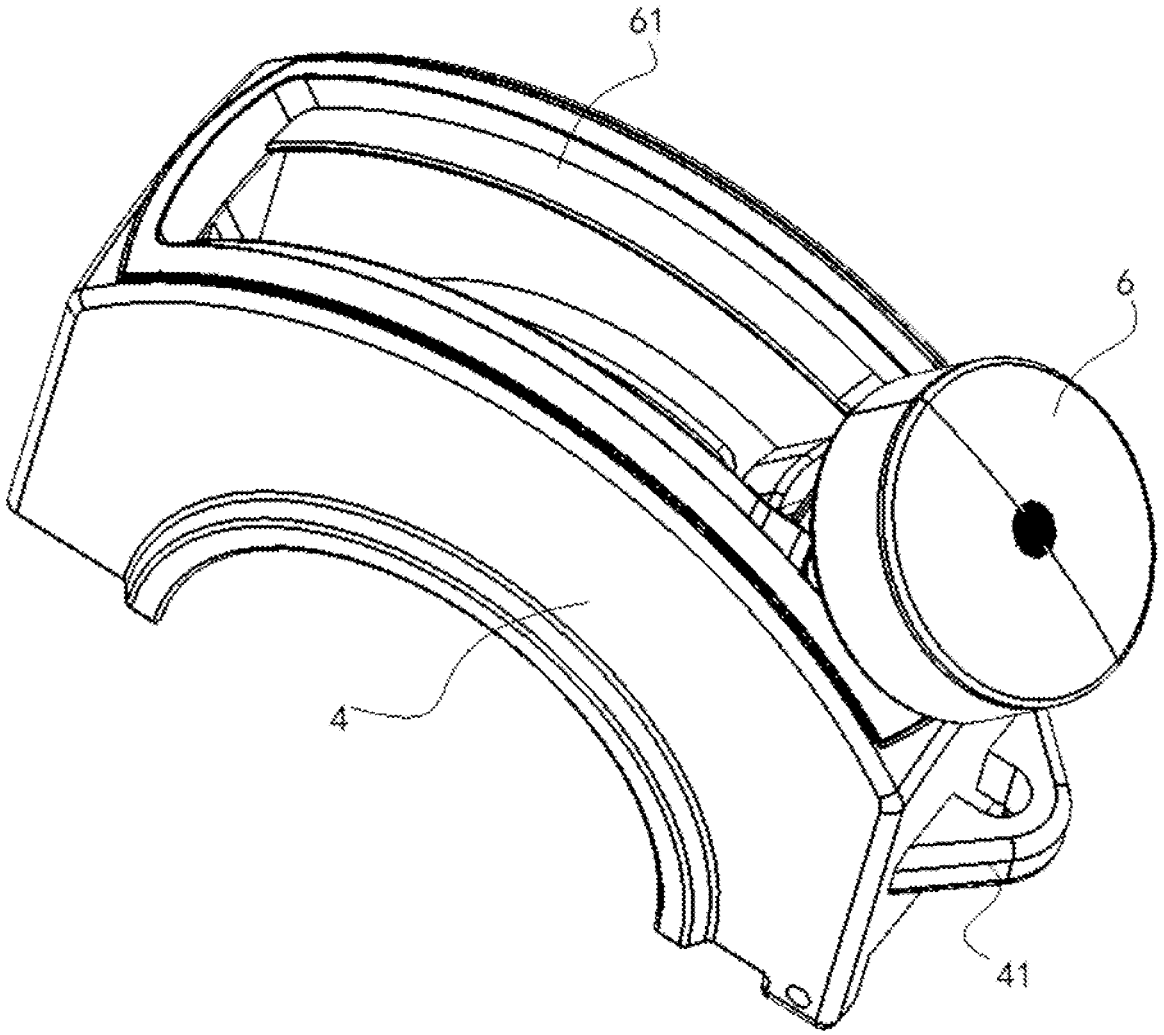
FIG. 3 is a schematic diagram illustrating a 3D structure of a second clip body in accordance with embodiments of the present disclosure.

FIG. 1 is schematic diagram illustrating a three-dimensional (3D) structure of a golf ball scriber in accordance with embodiments of the present disclosure. FIG. 2 is a schematic diagram illustrating a 3D structure in which a golf ball is installed inside a golf ball scriber in accordance with embodiments of the present disclosure. FIG. 3 is a schematic diagram illustrating a 3D structure of a second clip body in accordance with embodiments of the present disclosure. Referring to FIGS. 1 and 2, a golf ball scriber may include a clip 1, wherein the clip 1 may include a first clip body 3 and a second clip body 4. The first clip body 3 and the second clip body 4 are connected by a pivot shaft 2 (as shown in FIGS. 1 and 2).

According to an embodiment, a clamping groove surface 5 may be disposed on an inner surface of the first clip body 3. A substantially similar clamping groove surface 5 may also be disposed on an inner surface of the second clip body 4. The clamping groove surface 5 may face a golf ball (see FIG. 2). In some cases, the clamping groove surface 5 may also be referred to as a slot surface due to having a slot area disposed on the clamping groove surface 5.

Referring to FIG. 2, an inner clamping surface ofthe clip 1 may include a clamping groove surface 5 which is matched with the spherical surface of a golf ball 7. The golf ball 7 may fit tightly in between the first clip body 3 and the second clip body 4. The spherical surface of the golf ball may be at least partially surrounded by an inner surface of the first clip body 3 and an inner surface of the second clip body 4.

According to an embodiment, the golf ball scriber may include a brush device 6 disposed on an outer surface of the first clip body 3. A substantially similar brush device 6 may be disposed on an outer surface of the second clip body 4. The brush device 6 may be in sliding connection with a clip groove 31 which is disposed on the first clip body 3 or the second clip body 4 (see FIG. 4).

Referring to FIG. 3, the second clip body 4 may include a U-shaped scribing track 61 and a brush device 6. According to an embodiment, a hook 41 may be disposed on a side wall of the second clip body 4.

Figure 4:
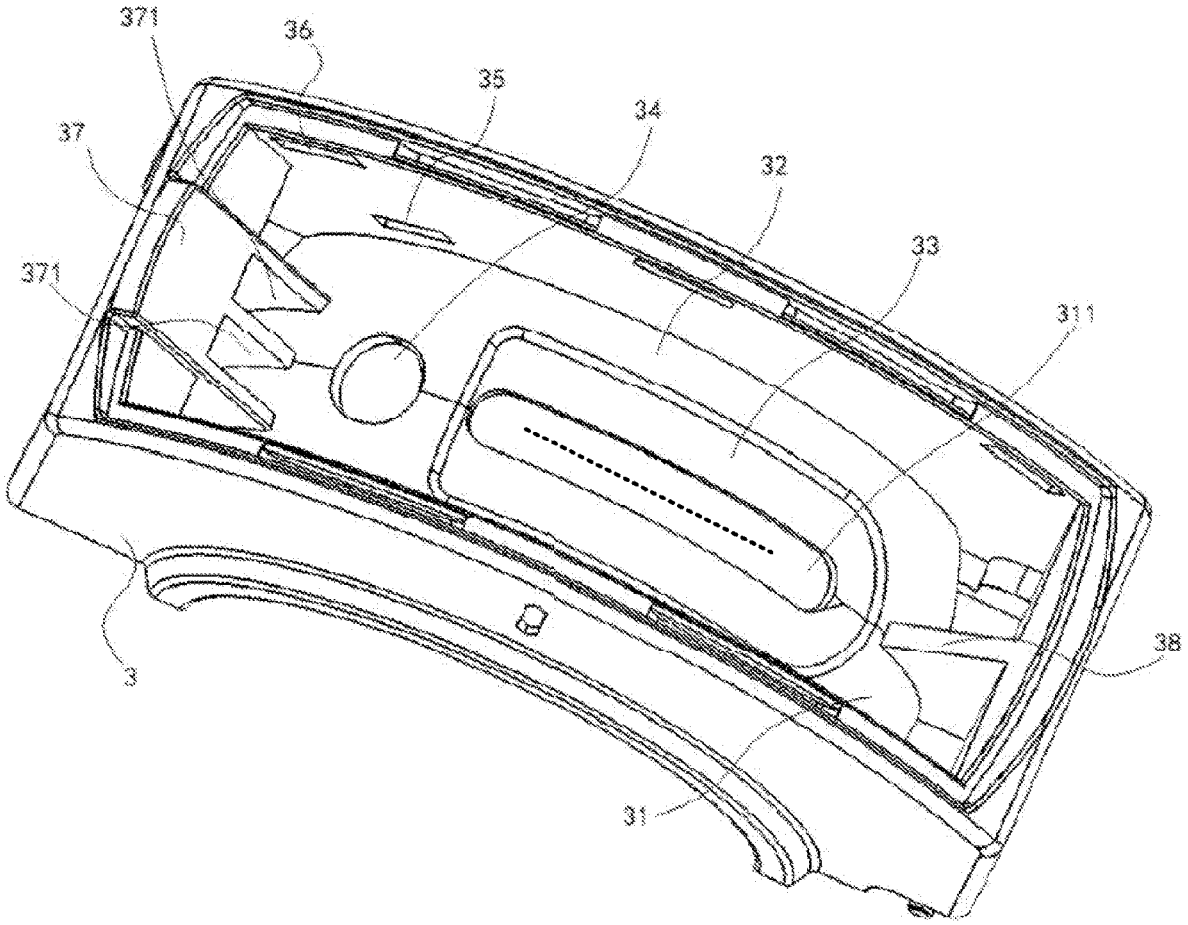
FIG. 4 is a schematic diagram of a 3D structure of a first clip body without a brush device implemented in accordance with embodiments of the present disclosure.

FIG. 4 is a schematic diagram of a 3D structure of a first clip body without a brush device implemented in accordance with embodiments of the present disclosure.

According to an embodiment, the first clip body 3 may include a clip groove 31, ascribing ruler 32, a strip-shaped chamfered groove 33, and a U-shaped scribing track 61. The second clip body 4 may have a substantial similar configuration as the first clip body 3. The second clip body 4 may also include a clip groove 31, a scribing ruler 32, a strip-shaped chamfered groove 33, and a U-shaped scribing track 61. In some cases, the scribing ruler 32 may also be referred to as a scribing scale.

To the extent that a description of an element has been omitted, it may be assumed that the description is at least similar to that of corresponding elements that have been described elsewhere in the instant specification.

According to an embodiment, the clip groove 31 may be disposed on an outer wall of the first clip body 3. A substantially similar clip groove 31 may be disposed on an outer wall of the second clip body 4. In some examples, the clip groove 31 disposed on the outer wall of the first clip body 3 may be referred to as a first clip groove 31. Similarly, the clip groove 31 disposed on the outer wall of the second clip body 4 may be referred to as a second clip groove 31.

According to an embodiment, the clip grooves 31 may be symmetrically disposed on a respective outer wall of the first clip body 3 and the second clip body 4. The scribing ruler 32 may be disposed at the bottom of the clip groove 31. The strip-shaped chamfered groove 33 may be disposed on the scribing ruler 32. The strip-shaped chamfered groove 33 may be spaced apart or disposed away from a clamping groove surface 5 along the radial direction of the clip 1. A strip-shaped scribing groove 311 may be disposed on the chamfered groove 33 which corresponds to the clamping groove surface 5. The scribing ruler 32, the strip-shaped chamfered groove 33 and the scribing groove 311 may share a same center line.

According to an embodiment, the first clip body 3 may include a brush device 6 which is in sliding connection with the clip groove 31 disposed on the first clip body 3. Referring back to FIG. 1, the second clip body 4 includes a substantially similar brush device 6. The brush device 6 may be in sliding connection with the clip groove 31 disposed on the second clip body 4.

According to an embodiment, when the brush device 6 is scribing, due to structure of the strip-shaped chamfered groove 33, friction of the brush device 6 is reduced and its duration of service life is prolonged.

According to an embodiment, the brush device 6 may be in sliding connection with the clip groove 31 on the first clip body 3 or the second clip body 4.

As illustrated i FIG. 4, a clamping hole 34 which is clamped with the sealing cover 66 may be disposed at the bottom of the clip groove 31, and the clamping hole 34 may be disposed at one end of the chamfered groove 33. The clamping hole 34 may share a same central line with the chamfered groove 33. In an embodiment, the scribing ruler, the chamfered groove, and the scribing groove share an imaginary central line (indicated as a dashed line in FIG. 4).

According to an embodiment, a No. 1 mortise 35 may be disposed on each of two symmetrical side walls which are disposed inside the clip groove 31 along the axial direction of the clip 1. The No. 1 mortise 35 may be adapted to a No. 1 tenon 662 disposed on the sealing cover 66.

According to an embodiment, at least two No. 2 mortises 36 may be arranged at equal intervals and disposed on each of two symmetrical side walls inside the clip groove 31 along the axial direction of the clip 1, and the No. 2 mortises 36 may be arranged along the radial direction of the clip 1.

According to an embodiment, a No. 2 tenon 611 may be disposed on each of two outer walls of the U-shaped scribing track 61 along the radial direction of the clip 1. The No. 2 tenon 611 may be adapted to the No. 2 mortise 36. For example, a size/type of the No. 2 tenon 611 may match with a size/type of the No. 2 mortise 36. The No. 2 mortise 36 may be disposed at the upper part of the No. 1 mortise 35. In this way, the sealing cover 66 may be located at the lower part of the U-shaped scribing track 61.

According to an embodiment, when a pen core 63 is separated from the sealing cover 66, the pen core 63 may be displaced on the U-shaped scribing track 61. At the same time, under the compression of the spring 62, a pen nib of the pen core 63 may enter the scribing groove 311 to scribe the spherical surface of the golf ball 7.

As shown in FIG. 4, the clamping block 37 may be disposed in the middle of the side wall on the side of the clamping hole 34 in the clip groove 31. The clamping block 37 may be adjacent to the clamping hole 34. For example, the clamping block 37 may be spaced apart from the clamping hole 34. According to an embodiment, the clamping block 37 is clamped in a bayonet 612 of the U-shaped scribing track 61 (see FIG. 13).

According to an embodiment, the clamping block 37 may include opening grooves 371. For example, two opening grooves 371 may be disposed on the bottom side of the clamping block 37.

According to an embodiment, a reinforcing rib 38 may be disposed adjacent to the side wall inside the first clip body 3. The reinforcing rib 38 may be disposed opposite to the location of the clamping block 37.

According to one or more embodiments, the U-shaped scribing track 61 may be fixed on the first clip body 3 such that the brush device 6 is connected to the clip 1. A same U-shaped scribing track 61 may be fixed on the second clip body 4. A same brush device 6 may be disposed on the second clip body 4.

According to an embodiment, two opening grooves 371 may be formed in the lower part of the clamping block 37 along the height direction. When the clamping block 37 is opened in the bayonet 612, the opening grooves 371 may be disposed in the bayonet 612.

According to an embodiment, an inclined reinforcing rib 38 may be disposed at one end of the clip groove 31 opposite to the clip block 37. The bottom of the reinforcing rib 38 may be seamlessly connected with the scribing ruler 32. The arrangement of the reinforcing rib 38 enables relatively easy demoulding in the preparation process.

Figure 5:
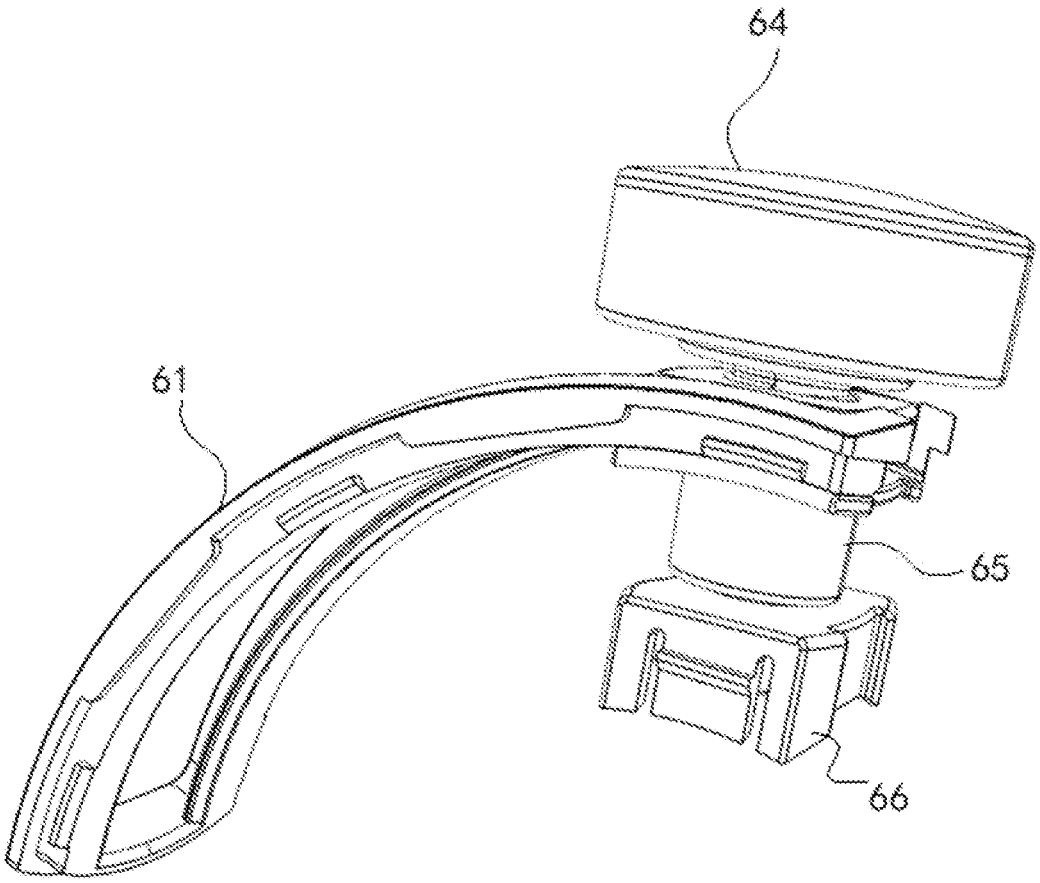
FIG. 5 is a schematic diagram illustrating a 3D structure of a sealed brush device in accordance with embodiments of the present disclosure.
Figure 6:
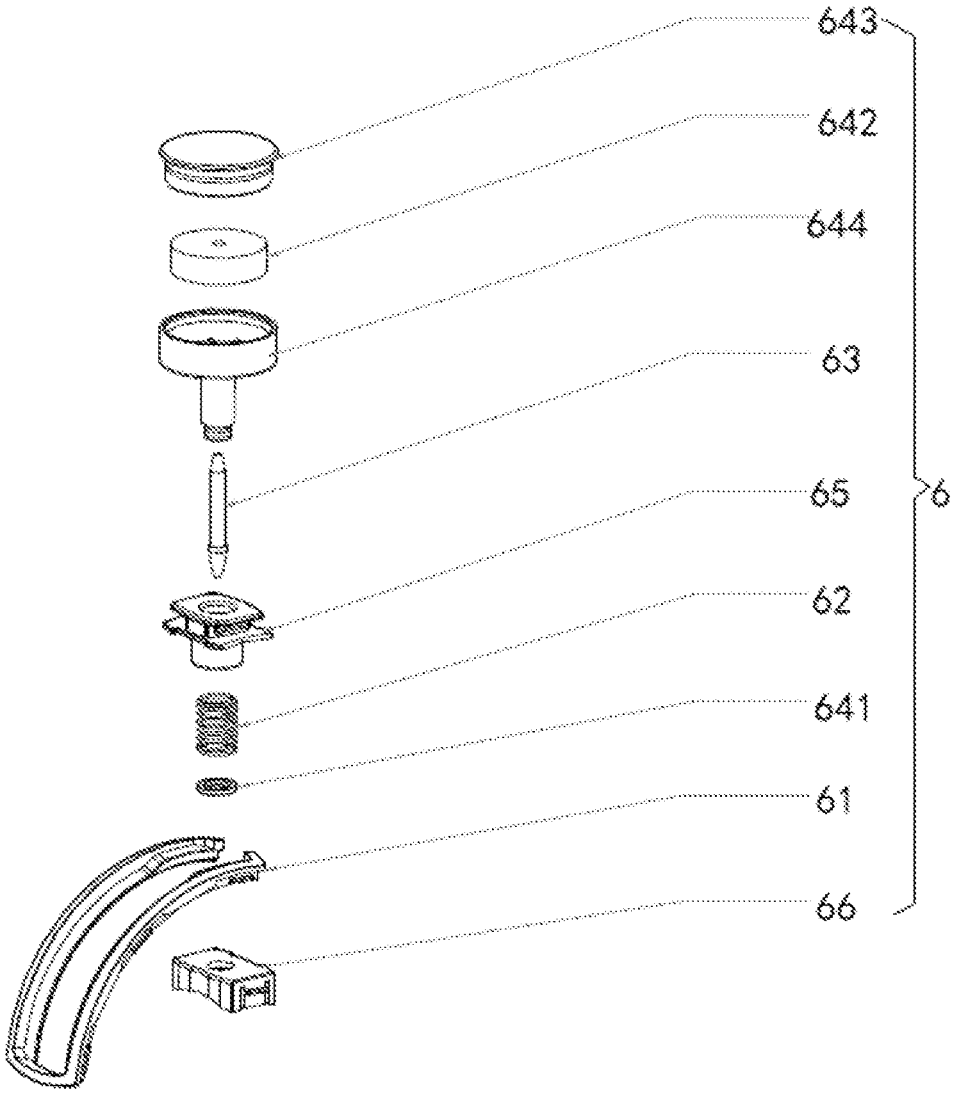
FIG. 6 is a schematic diagram illustrating an exploded view of a sealed brush device in accordance with embodiments of the present disclosure.

FIG. 5 is a schematic diagram illustrating a 3D structure of a sealed brush device in accordance with embodiments of the present disclosure. FIG. 6 is a schematic diagram illustrating an exploded view of a sealed brush device in accordance with embodiments of the present disclosure.

The brush device 6 may include a U-shaped scribing track 61, a spring 62, a pen core 63, an ink tank 64, a scribing guide sleeve 65 and a sealing cover 66, which are sequentially connected from top to bottom.

According to an embodiment, as illustrated in FIG. 6, the ink tank 64, the pen core 63, scribing guide sleeve 65, the spring 62, a spring retainer 641, the U-shaped scribing track 61, and the sealing cover 66 may be sequentially connected from top to bottom. The U-shaped scribing track 61 may be disposed and connected to the clip groove 31 of the first clip body 3.

According to an embodiment, the ink tank may include a box cover 643, an ink absorbent cotton 642, and ink box 644. The ink tank may be disposed on the scribing guide sleeve 65.

According to an embodiment, the spring 62 may be sleeved in the scribing guide sleeve 65 and coaxial with the scribing guide sleeve 65. The spring retainer 641 may be sleeved on the outer periphery of a lower part of the ink tank 64.

According to an embodiment, the top end of the pen core 63 may be located in the ink tank 64, and the low end of the pen core 63 may penetrate through the scribing guide sleeve 65 and then extend into the sealing cover 66. The top end of the spring 62 may be flush with the upper end surface of the scribing guide sleeve 65. The bottom end of the spring 62 may abut against the upper end surface of the spring retainer 641. The spring retainer 641 may be located in the scribing guide sleeve 65 and coaxial with the scribing guide sleeve 65, and the lower end surface of the spring retainer 641 may be flush with the lower end surface of the scribing guide sleeve 65.

Figure 7:
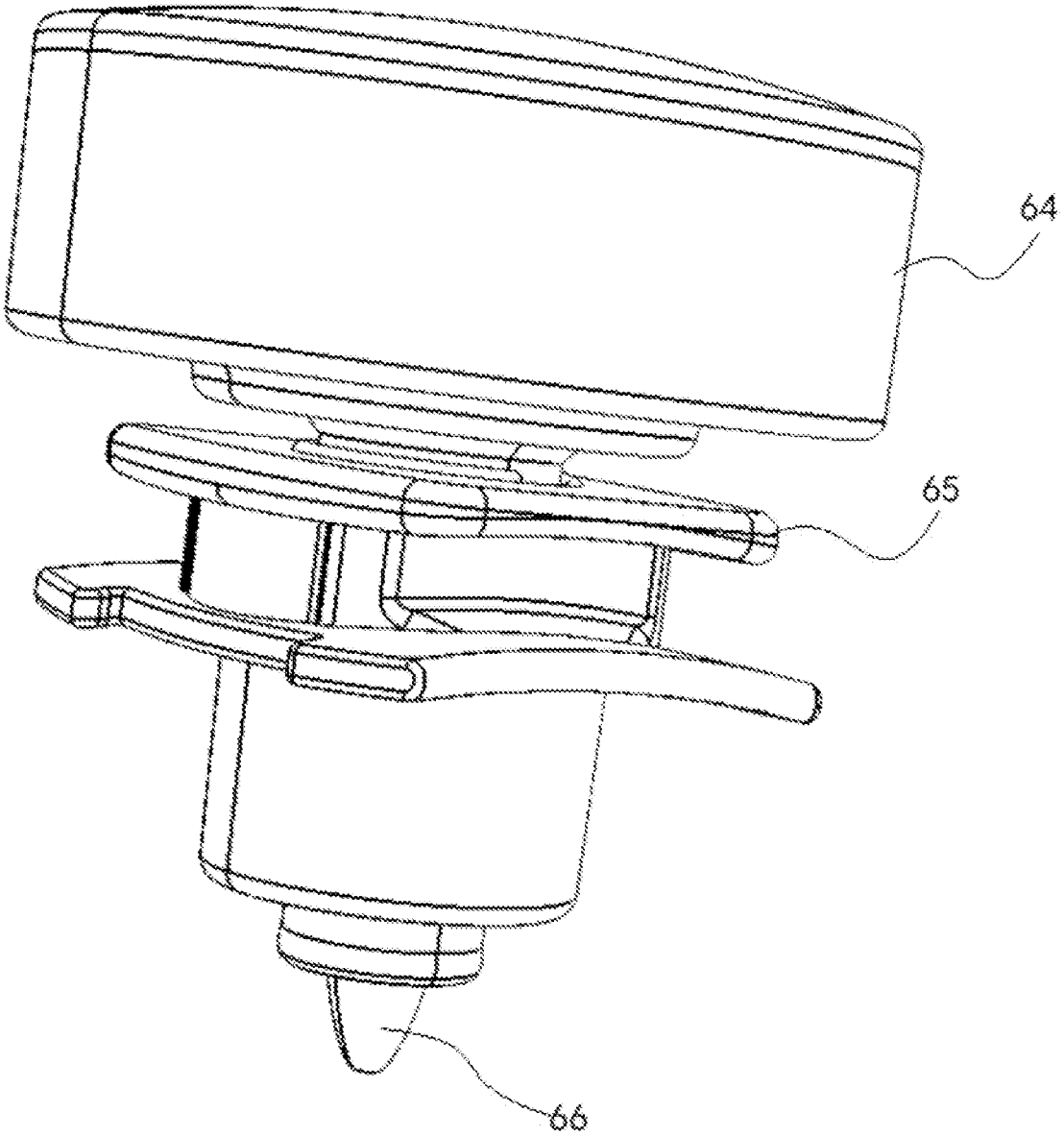
FIG. 7 is a schematic diagram of a 3D structure of a sealed brush device without a U-shaped scribing track or a sealing cover implemented in accordance with embodiments of the present disclosure.

FIG. 7 is a schematic diagram of a 3D structure of a sealed brush device without a U-shaped scribing track or a sealing cover implemented in accordance with embodiments of the present disclosure. According to an embodiment, the brush device may include the ink tank 64, the scribing guide sleeve 65, and the sealing cover 66. The ink tank 64, the scribing guide sleeve 65, and the sealing cover 66 may be connected sequentially from top to bottom.

Figure 8:
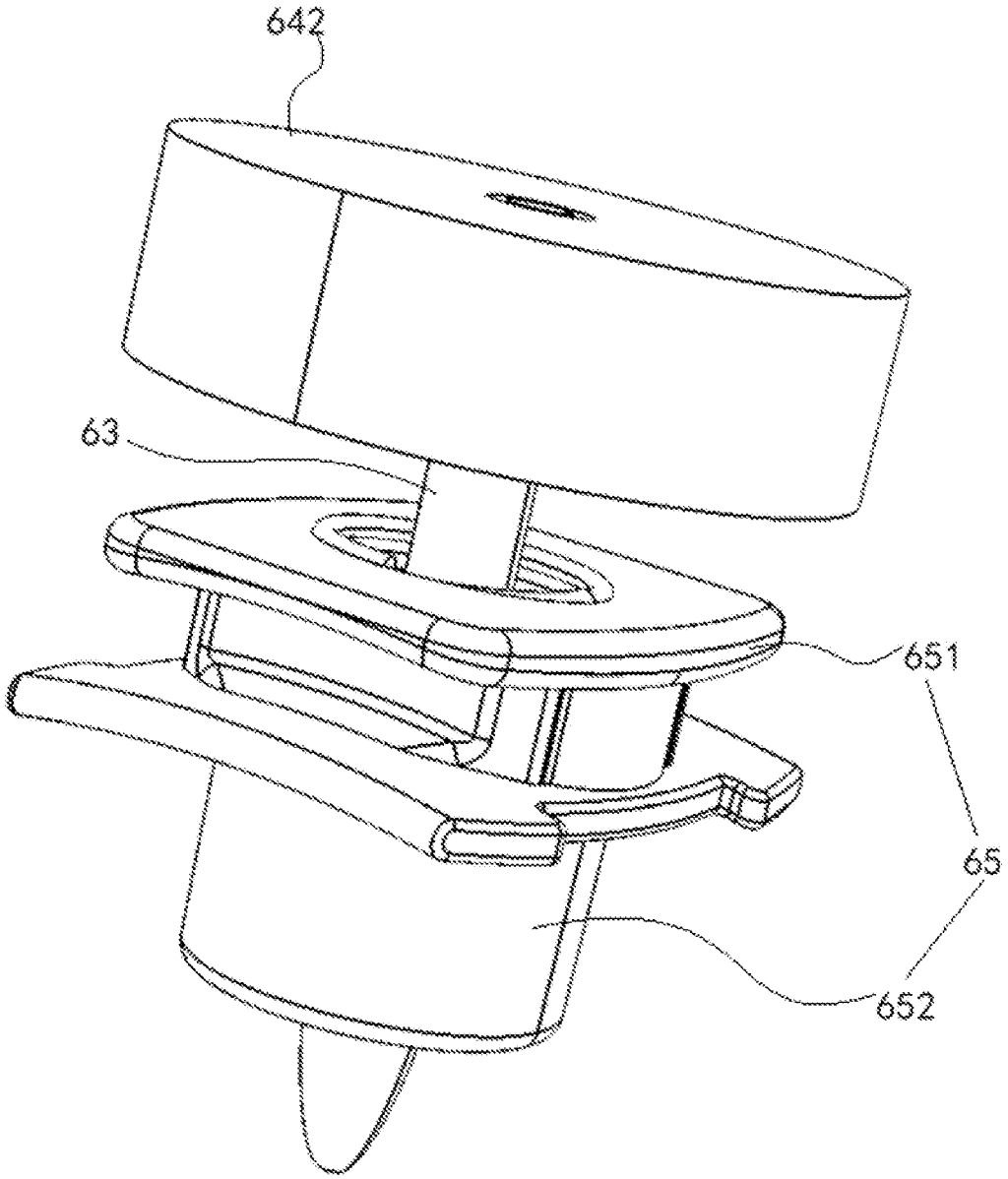
FIG. 8 is a schematic diagram of a 3D structure of a sealed brush device not including a box cover or an ink cover from a different perspective than FIG. 7 in accordance with embodiments of the present disclosure.

FIG. 8 is a schematic diagram of a 3D structure of a sealed brush device not including a box cover or an ink cover from a different perspective than FIG. 7 in accordance with embodiments of the present disclosure. According to an embodiment, ink absorbent cotton 642 may be disposed inside the ink tank 64. The scribing guide sleeve 65 may include an I-shaped scribing body 651 and a No. 2 hollow cylinder 652.

According to an embodiment, the pen core 63 may penetrate the scribing guide sleeve 65 and the ink absorbent cotton 642. For example, the pen core 63 extend into the scribing guide sleeve 65 and the ink absorbent cotton 642. Accordingly, the scribing guide sleeve 65 and the ink absorbent cotton 642 may be connected.

Figure 9:
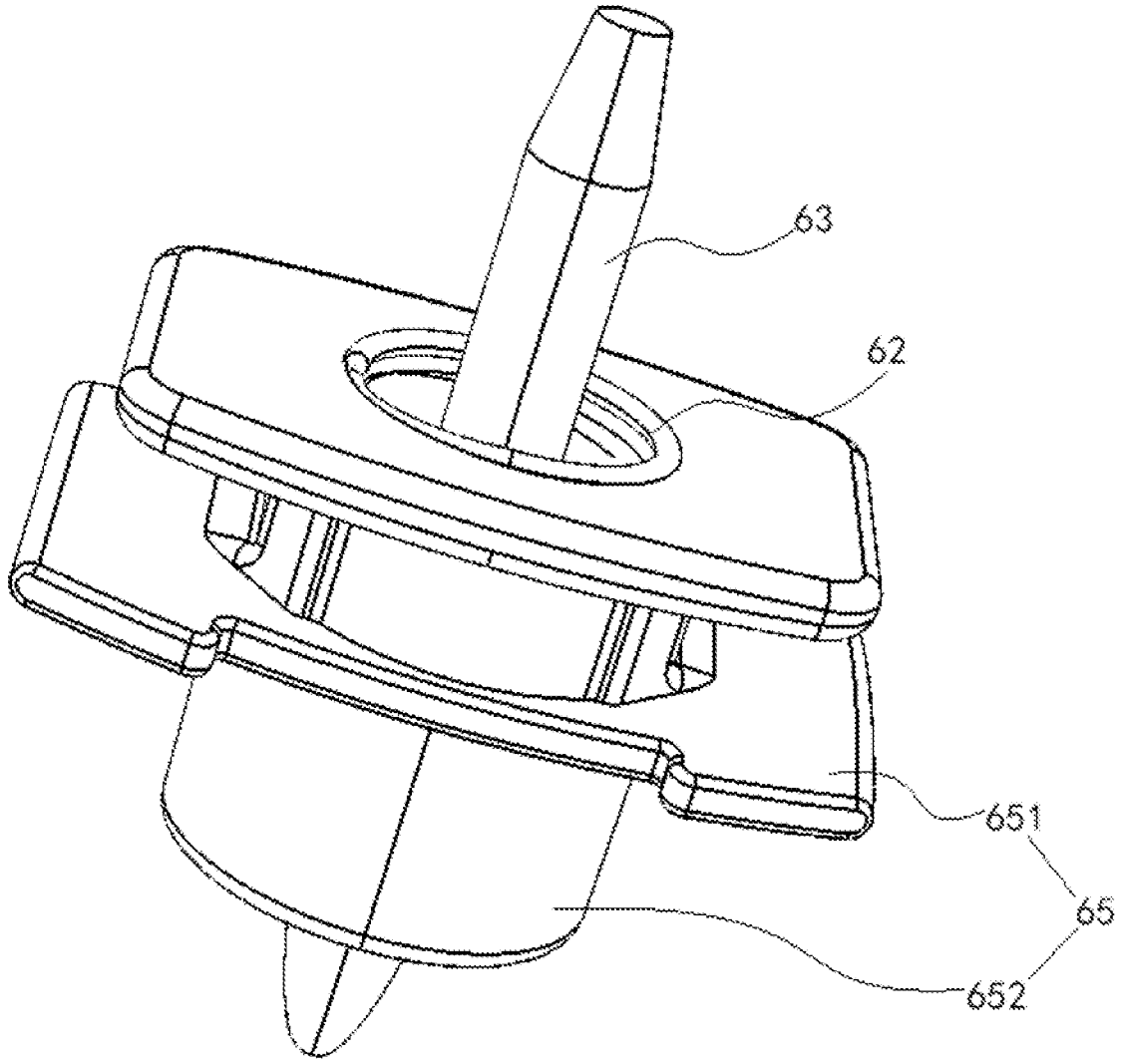
FIG. 9 is a schematic diagram of a 3D structure of a sealed brush device from a different perspective than FIG. 8 in accordance with embodiments of the present disclosure.
Figure 10:
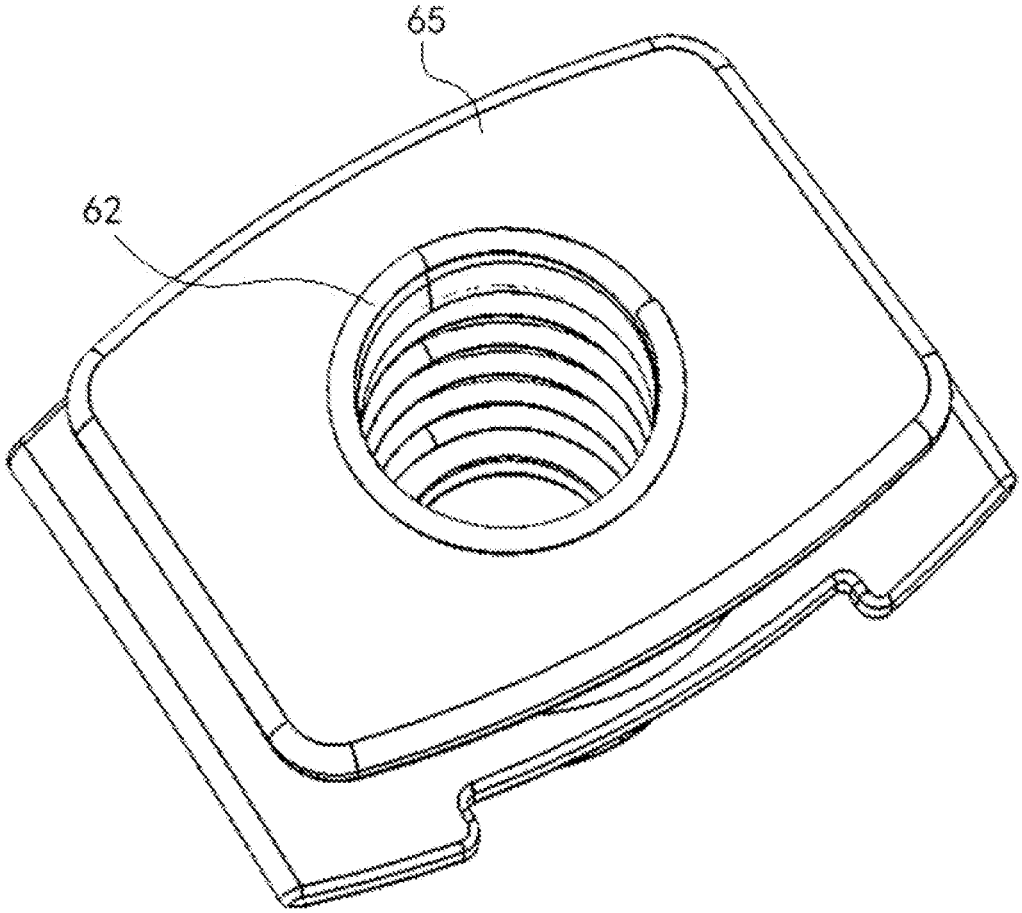
FIG. 10 is a schematic diagram of a 3D structure of a scribing guide sleeve including a spring in accordance with embodiments of the present disclosure.

FIG. 9 is a schematic diagram of a 3D structure of a sealed brush device from a different perspective than FIG. 8 in accordance with embodiments of the present disclosure. FIG. 10 is a schematic diagram of a 3D structure of a scribing guide sleeve including a spring in accordance with embodiments of the present disclosure.

According to an embodiment, the spring 62 may be sleeved in the scribing guide sleeve 65 and coaxial with the scribing guide sleeve 65. The top end of the spring 62 may be flush with the upper end surface of the scribing guide sleeve 65. For example, the top end of the spring 62 may be on a same level as the upper end surface of the scribing guide sleeve 65. The bottom end of the spring 62 may abut against the upper end surface of the spring retainer 641.

Figure 11:
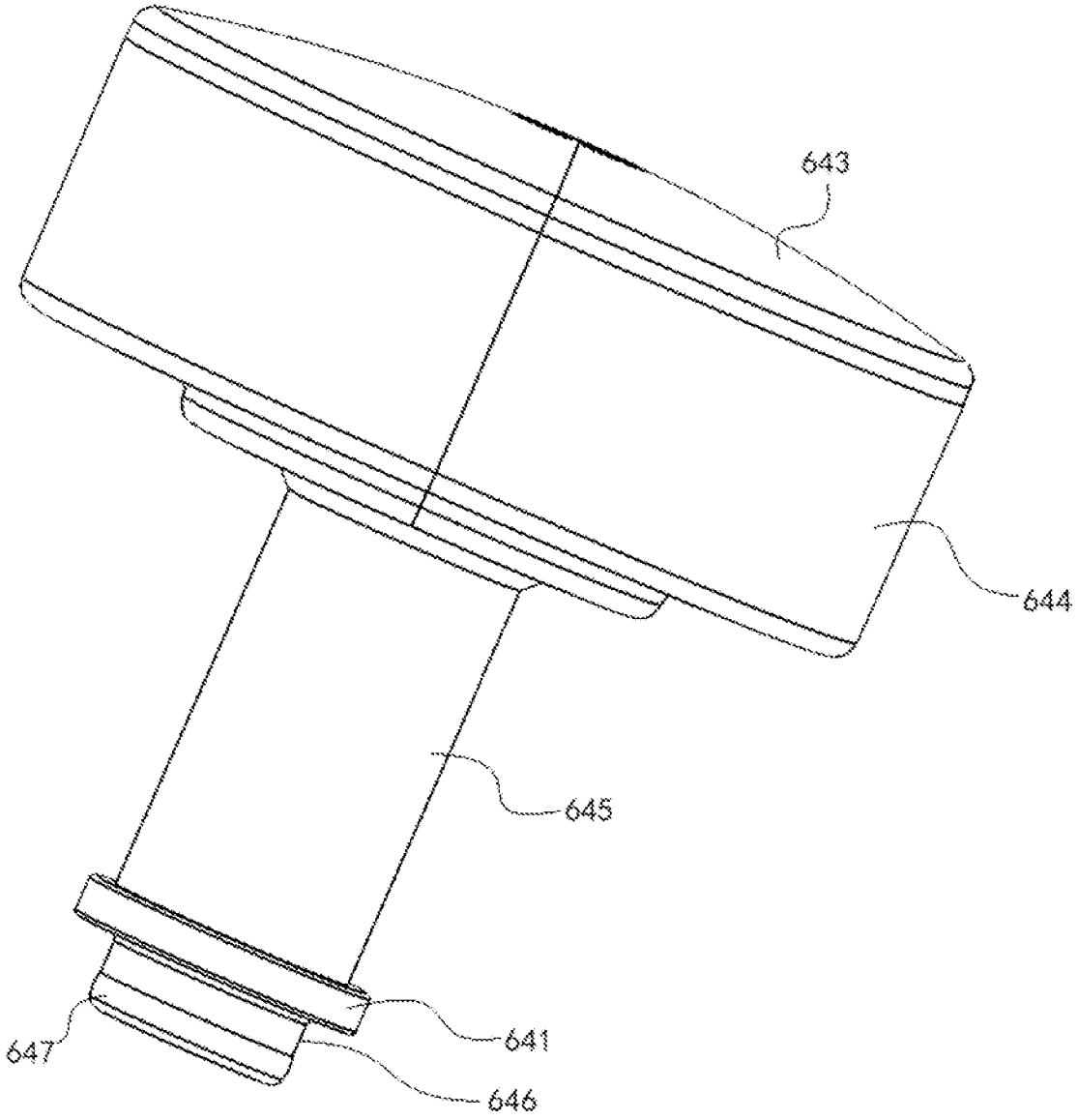
FIG. 11 is a schematic diagram of a 3D structure of an ink tank in accordance with embodiments of the present disclosure.
Figure 12:
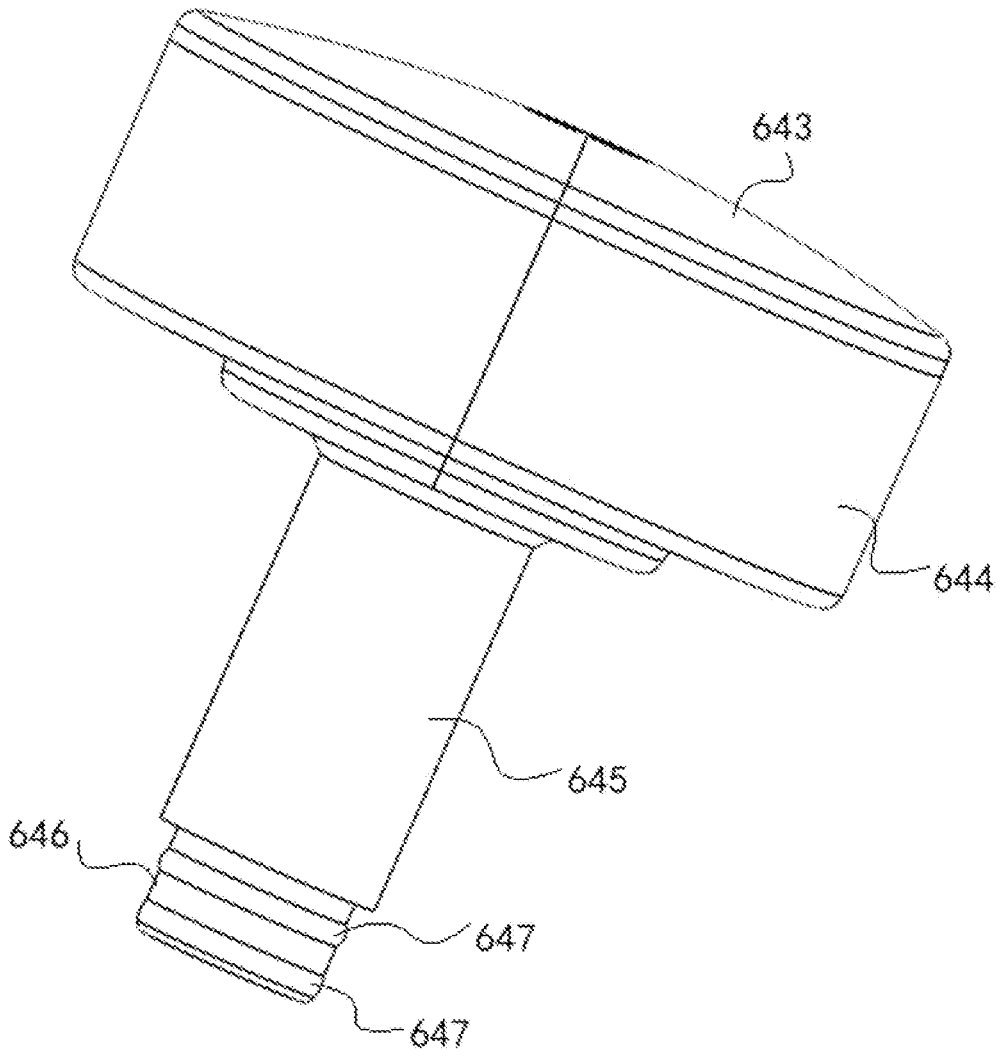
FIG. 12 is a schematic diagram of a 3D structure of an ink tank where the ink tank is not provided with a spring retainer in accordance with embodiments of the present disclosure.

FIG. 11 is a schematic diagram of a 3D structure of an ink tank in accordance with embodiments of the present disclosure. FIG. 12 is a schematic diagram of a 3D structure of an ink tank where the ink tank is not provided with a spring retainer in accordance with embodiments of the present disclosure.

According to an embodiment, the ink tank 64 may include ink absorbent cotton 642, box cover 643, ink box 644 and a No. 1 hollow cylinder 645, which are connected from top to bottom. The box cover 643 may be rotatably connected with the ink box 644 and may form the space for accommodating the ink absorbent cotton 642 (see FIG. 6). During a scribing process via the pen core 63, the ink absorbent cotton 642 may be co-extruded by the box cover 643 and the ink box 644. In this way, the ink may be extruded and used by the pen core 63 for scribing operation.

According to an embodiment, the ink contained in the ink tank 64 may include custom-made ink for marking or scribing the golf ball 7, where the ink can be quickly dried and water cannot scrub it off. When ink needs to be added into the ink tank 64, the box cover 643 may be opened by rotation (e.g., by a user), and ink may be poured into the ink box 644 from the box cover 643, thus completing the replenishment of ink for the scribing tool.

According to an embodiment, the No. 1 hollow cylinder 645 may be vertically connected with the bottom of the ink box 644 and the No. 1 hollow cylinder 645 may be coaxial with the bottom of the ink box 644. The lower part of the No. 1 hollow cylinder 645 may include an abutting section 646 with an outer diameter smaller than that of the upper part. The abutting section 646 may be provided with two circles of abutting parts 647 arranged at intervals along its circumferential direction, and the two circles of abutting parts 647 may be coaxial with the No. 1 hollow cylinder 645 and arranged up and down. In some examples, the abutting parts 647 may include an upper abutting part 646 and a lower abutting part 646.

According to an embodiment, the spring retainer 641 may be sleeved on the upper abutting part 646, and there is a gap between the lower abutting part 646 and the lower end surface of the abutting section 646, so that the bottom end surface of the abutting part 646 may extend into the sealing cover 66. When the scribing tool is in a standby state, the spring 62 may be in a semi-compressed state, and the scribing end of the pen core 63 abuts against the sealing cover 66. When scribing is needed, the scribing tool is lifted first, and at this time, the spring 62 may be compressed under the action of the spring retainer 641. Then, when the brush device 6 slides on the U-shaped scribing track 61 to the scribing groove 311, the pen nib of the pen core 63 may pass through the scribing groove 311 to scribe on the spherical surface of the golf ball 7.

According to an embodiment, the scribing guide sleeve 65 may include an I-shaped scribing body 651 and the No. 2 hollow cylinder 652. The No. 2 hollow cylinder 652 may be integrally connected to the lower part of the I-shaped scribing body 651 and may be coaxial with the I-shaped scribing body 651. The spring retainer 641 may be disposed in the lower part of the No. 2 hollow cylinder 652 and the spring retainer 641 may be flush with bottom end surface of the No. 2 hollow cylinder 652. For example, the spring retainer 641 may be disposed on a same level as the bottom end surface of the No. 2 hollow cylinder 652.

According to an embodiment, the spring 62 may be disposed between the scribing guide sleeve 65 and the No. 1 hollow cylinder 645 and may move along the No. 1 hollow cylinder 645 in the corresponding axial direction.

Figure 13:
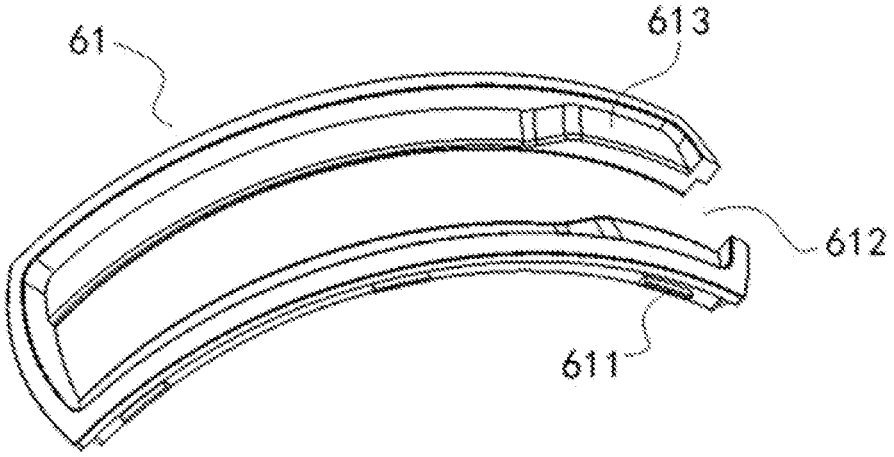
FIG. 13 is a schematic diagram of a 3D structure of a U-shaped scribing track in accordance with embodiments of the present disclosure.

FIG. 13 is a schematic diagram of a 3D structure of a U-shaped scribing track in accordance with embodiments of the present disclosure. According to an embodiment, the rails on both sides of the bayonet 612 may be symmetrically provided with clamping tables 613 for clamping the scribing guide sleeve 65. An upper end surface of the clamping table 613 may be higher than an upper end surface of the upper track of the U-shaped scribing track 61.

According to an embodiment, a portion of the clamping table 613 away from the bayonet 612 may have a slope and may be connected with at least a track disposed on the U-shaped scribing track 61. According to an embodiment, the hook 41 may be implemented on a vertical surface of the first clip body 3 or the second clip body 4.

Figure 14:
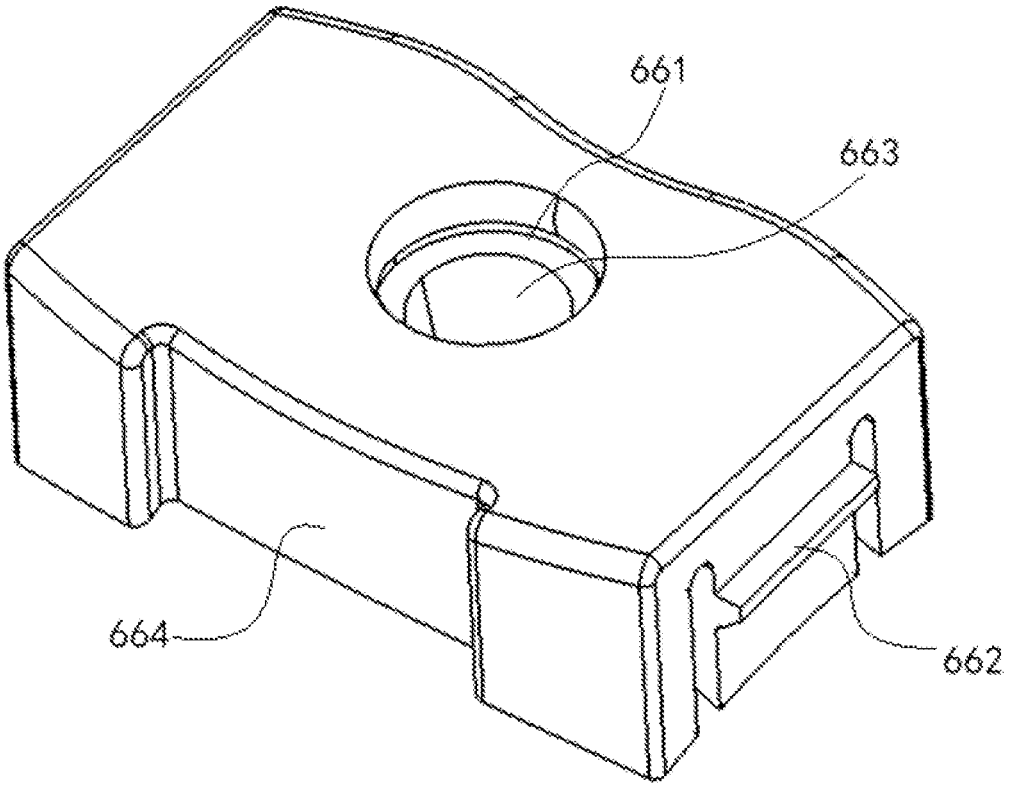
FIGS. 14 and 15 are schematic diagrams illustrating a structure of a sealing cover of a brush device from different viewpoints in accordance with embodiments of the present disclosure.
Figure 15:
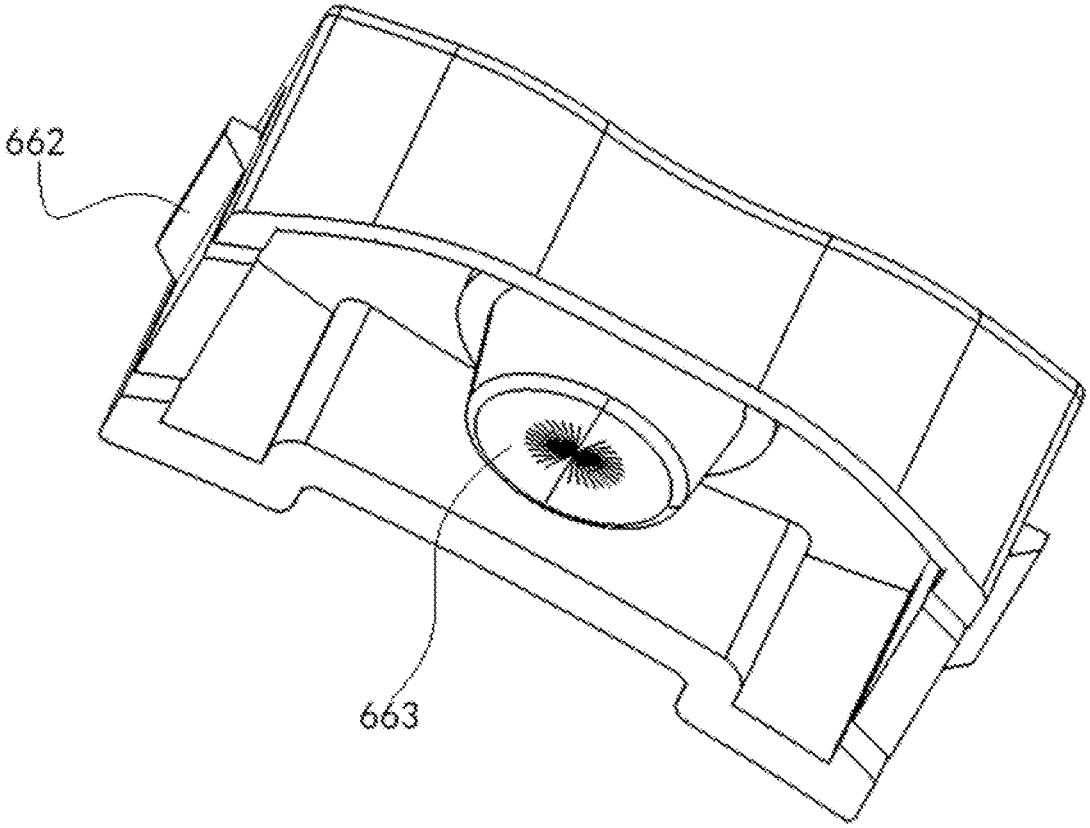

FIGS. 14 and 15 are schematic diagrams illustrating a structure of a sealing cover of a brush device from different viewpoints in accordance with embodiments of the present disclosure. According to an embodiment, the clamping groove 664 may be arranged on one side of the sealing cover 66. The clamping groove 664 may be adapted to the lower part of the clamping block 37. For example, a size/type of the clamping groove 664 may match with a size/type of the lower part of the clamping block 37. As a result, the stability of the connection between the sealing cover 66 and the clip groove 31 is maintained. In the meantime, the overall connectivity performance between the sealing cover 66 and the clip groove 31 is increased.

According to an embodiment, an upper end groove 661 may be disposed on an upper end surface of the sealing cover 66. The upper end groove 661 may match with the abutting parts 647 at the upper and lower parts of the abutting section 646. The lower part of the upper end groove 661 may be coaxially provided with a conical clamping cylinder 663 adapted to the clamping hole 34. For example, the conical clamping cylinder 663 may be disposed in the upper end groove 661. The conical clamping cylinder 663 may match with the clamping hole 34. The bottom end surface of the conical clamping cylinder 663 may not be in contact with the spherical surface of the golf ball 7.

When the golf ball scriber is in a standby state, the pen nib of the pen core 63 may be placed in the conical clamping cylinder 663. According to an embodiment, there may be a gap between the pen nib of the pen core 63 and the inner bottom surface of the conical clamping cylinder 663. The gap distance may be about 2.5 mm to about 3 mm. The pen core 63 can be sealed and kept in a moist state, and can be used directly and immediately when a user is ready to scribe a golf ball. According to some embodiments, the ink can be dried quickly and water cannot scrub the ink off. However, the ink is not dried out on the pen nib of the pen core 63 and can be reused for duration of time. As a result, the brush device, along with the pen nib, can be used for multiple times and for relatively long time.

According to one or more embodiments, unlike conventional technology separating the scribing pen (e.g., a brush device) from the scriber, a golf ball scriber of the present inventive concept integrates the brush device (e.g., the brush device is a part of the scriber). As a result, the scriber is more convenient to carry and more suitable for users to scribe or mark lines on a surface of a golf ball.

As illustrated in FIGS. 5-6 and FIG. 14, the sealing cover 66 may be located in the clip groove 31, and the scribing guide sleeve 65 may be clamped on the U-shaped scribing track 61, so that when it slides on the U-shaped scribing track 61 to the scribing groove 311 of clip groove 31, the pen nib of the pen core 63 may pass through the scribing groove 311 to scribe on the spherical surface of the golf ball 7.

Referring to FIGS. 12-14, one or more abutting parts 647 may be disposed at the upper and lower parts of the abutting section 646 and may be disposed in the upper end groove 661, so that the ink tank 64 moves towards the sealing cover 66 and abuts against the upper end groove 661 of the sealing cover 66 through the lower abutting part 647.

An example process of operating the golf ball scriber is described below with reference to FIGS. 1-15. According to one or more embodiments, when the scriber or scribing tool is in a standby state, the clip 1 and the brush device 6 may be integrated. At this time, under the semi-compression of the spring 62, the pen core 63 may be pressed against the sealing cover 66 to form a complete sealing system.

When the scriber or scribing tool is at working condition, firstly, the golf ball 7 is put into the clamping groove surface 5 of the clip 1, and a user operating the golf ball scriber (e.g., golf ball player) can select the scribing position according to personal habits. For example, the spherical surface of the golf ball 7 may be exposed on both sides (FIG. 2) and the golf ball 7 may be rotated inside the clip 1 before the user scribes. In the meantime, the user can gaze at the spherical surface from the scribing groove 311 and the user may select a suitable position for scribing.

According to one or more embodiments, the ink tank 64 may be lifted (e.g., user's hand). At this time, due to the cooperative action of scribing guide sleeve 65 and the sealing cover 66, the spring 62 is in a fully compressed state after contraction, and the pen core 63 is lifted from the sealing cover 66 and moves to the side of the U-shaped scribing track 61. When the pen core 63 corresponds to the scribing groove 311 and needs to be scribed, the ink tank 64 may be released. At this time, the spring 62 may press down the brush device 6, and the spring 62 is in an extended state, so that the pen nib of the pen core 63 may be in contact with the spherical surface of the golf ball 7 for scribing or marking lines on the golf ball.

While the inventive concept has been particularly shown and described with reference to the example embodiments thereof, it will be understood by one of ordinary skill in the art that variations in form and detail may be made therein without departing from the spirit and scope of the inventive concept.

What is claimed is:

1. A golf ball scriber, comprising:

a clip comprising a first clip body and a second clip body which are connected by a pivot shaft;

a clamping groove surface disposed on an inner clamping surface of the clip;

a sealed brush device;

a first clip groove and a second dip groove symmetrically arranged on a respective outer wall of the first clip body and the second clip body;

a scribing ruler disposed at a bottom surface of the first clip groove;

a strip-shaped chamfered groove disposed on the scribing ruler away from the clamping groove surface along a radial direction of the clip; and a strip-shaped scribing groove disposed on the chamfered groove which corresponds to the clamping groove surface, wherein the scribing ruler, the chamfered groove, and the scribing groove share an imaginary central line, and wherein the brush device is in sliding connection with the first clip groove disposed on the first clip body.

2. The golf ball scriber of claim 1 wherein the brush device further comprises:

a U-shaped scribing track;

an ink tank;

a pen core;

a scribing guide sleeve;

a spring, wherein the spring is sleeved in the scribing guide sleeve and is coaxial with the scribing guide sleeve;

a sealing cover wherein the ink tank, the scribing guide sleeve, and the sealing cover are sequentially connected from top to bottom, and wherein the U-shaped scribing track is connected to the first clip groove; and a spring retainer, wherein the spring retainer is sleeved on an outer periphery of a lower pan of the ink tank, wherein a top end of the pen core is disposed in the ink tank, wherein a low end of the pen core passes through the scribing guide sleeve and enter the sealing cover, wherein a top end of the spring is flush with an upper end surface of the scribing guide sleeve, and wherein a bottom end abuts against the upper end surface of the spring retainer.

3. The golf ball scriber of claim 2, wherein the spring retainer is disposed in the scribing guide sleeve and is coaxial with the scribing guide sleeve, and wherein a lower end surface of the spring retainer is flush with a lower end surface of the scribing guide sleeve.

4. The golf ball scriber of claim 2, wherein the sealing cover is disposed in the first clip groove, and the scribing guide sleeve is clamped on the U-shaped scribing track, and wherein as the scribing guide sleeve slides on the U-shaped scribing track to the scribing groove, a pen nib of the pen core passes through the scribing groove to scribe on a spherical surface of a golf ball.

5. The golf ball scriber of claim 2, wherein a clamping hole clamped with the sealing cover is disposed at the bottom of the first clip groove, and the damping, hole is located at one end of the chamfered groove, wherein the clamping hole and the chamfered groove share a same imaginary central line, wherein a number 1 mortise is disposed on each of two symmetrical side walls in the first clip groove along an axial direction of the clip, and wherein the number 1 mortise is adapted to a number 1 tenon disposed on the sealing cover.

6. The golf ball scriber of claim 5, wherein at least two number 2 mortises arranged at equal intervals are disposed on each of two symmetrical side walls in the first clip groove along the axial direction of the clip, wherein the at least two number 2 mortises are arranged along the radial direction of the clip, wherein a number 2 tenon is disposed on each of two outer walls of the U-shaped scribing track along the radial direction of the clip, and the number 2 tenon is adapted to each of the at least two number 2 mortises, wherein a clamping block is arranged in the middle of a side wall adjacent to the clamping hole in the first clip groove, and wherein the clamping block is clamped in a bayonet of the U-shaped scribing track.

7. The golf ball scriber of claim 2, wherein the ink tank further comprises:

an ink absorbent cotton;

a box cover;

an ink box; and a number 1 hollow cylinder, wherein the box cover, the ink box, and the number 1 hollow cylinder are connected from top to bottom, wherein the box cover and the ink box are rotatably connected and form a space for accommodating the ink absorbent cotton, wherein the number hollow cylinder is vertically connected with a bottom of the ink box and is coaxial with the ink box, and wherein a lower part of the number 1 hollow cylinder includes an abutting section with an outer diameter smaller than that of an upper part, and an abutting part is disposed on the abutting section along a circumferential direction.

8. The golf ball scriber of claim 7, wherein the ink tank moves towards the sealing cover, abutting against an upper end groove of the sealing cover through the abutting part, and wherein a gap exists between an upper end surface of the abutting section and the abutting part, and a gap exists between a lower end surface of the abutting section and the abutting part.

9. The golf ball scriber of claim 8, wherein the spring retainer is sleeved on the abutting section and the spring retainer is disposed on an upper part of the abutting part.

10. The golf ball scriber of claim 2, wherein the scribing guide sleeve further comprises:

an I-shaped scribing body; and a number 2 hollow cylinder, wherein the number 2 hollow cylinder is integrally connected to a lower part of the I-shaped scribing body and coaxial with the I-shaped scribing body, and wherein the spring retainer is disposed at a lower part of the number 2 hollow cylinder and is on a same level as a bottom end surface of the number 2 hollow cylinder.

11. The golf ball scriber of claim 1, wherein the brush device comprises a U-shaped scribing track and a clamping table, and wherein the clamping table is disposed on one end of the U-shaped scribing track.

12. The golf ball scriber of claim 11, wherein a height of the clamping table is higher than a height of a portion of the U-shaped scribing track.

13. A golf ball scriber, comprising:

a clip comprising a first clip body and a second clip body which are connected by a pivot shaft;

a clamping groove surface disposed on an inner clamping surface of the clip, a sealed brush device; and a first clip groove and a second clip groove symmetrically arranged on a respective outer wall of the first clip body and the second dip body, wherein the brush device is in sliding connection with the first clip groove disposed on the first clip body, wherein the brush device comprises a U-shaped scribing track and a clamping table, and wherein the clamping table is disposed on one end of the U-shaped scribing track.

14. The golf ball scriber of claim 13, further comprising:

a scribing ruler disposed at a bottom surface of the first clip groove;

a strip shaped chamfered groove disposed on the scribing ruler away from the damping groove surface along a radial direction of the clip; and a strip-shaped scribing groove disposed on the chamfered groove which corresponds to the clamping groove surface.

15. The golf ball scriber of claim 14, wherein the scribing ruler, the chamfered groove, and the scribing groove share an imaginary central line.

16. A brush device, comprising:

a U-shaped scribing track;

an ink tank:

a pen core;

a scribing guide sleeve;

a spring, wherein the spring is sleeved in the scribing guide sleeve and is coaxial with the scribing guide sleeve;

a sealing cover, wherein the ink tank, the scribing guide sleeve, and the sealing cover are sequentially connected from top to bottom, and wherein the U-shaped scribing track is connected to a clip groove; and a spring retainer, wherein the spring retainer is sleeved on an outer periphery of a lower part of the ink tank, wherein a top end of the pen core is disposed in the ink tank, wherein a low end of the pen core passes through the scribing guide sleeve and enter the sealing cover, wherein a top end of the spring is flush with an upper end surface of the scribing guide sleeve, and wherein a bottom end abuts against the upper end surface of the spring retainer.

* * * * *